United States Patent [19]

Gogniat

[11] Patent Number: 4,979,157

[45] Date of Patent: Dec. 18, 1990

[54] WATCH CASE PROVIDED WITH A CAP OF HARD MATERIAL

[75] Inventor: Paul Gogniat, Bienne, Switzerland

[73] Assignee: Montres Rado S.A., Lengnau, Switzerland

[21] Appl. No.: 473,310

[22] Filed: Feb. 1, 1990

[30] Foreign Application Priority Data

Feb. 14, 1989 [CH] Switzerland ..... 515/89

[51] Int. Cl.[5] ..... G04B 37/00

[52] U.S. Cl. ..... 368/276; 368/280; 368/294; 368/309

[58] Field of Search ..... 368/276, 278, 280, 283, 368/286, 294–296

[56] References Cited

U.S. PATENT DOCUMENTS

| | | | |
|---|---|---|---|
| 3,841,848 | 10/1974 | Kasai et al. | 368/280 |
| 4,417,821 | 11/1983 | Herchenbach | 368/291 |
| 4,620,798 | 11/1986 | Scarzini | 368/276 |
| 4,815,053 | 3/1989 | Dal-Busco | 368/294 |
| 4,831,606 | 5/1989 | Aellen | 368/282 |
| 4,853,910 | 8/1989 | Mock | 368/300 |

*Primary Examiner*—Vit W. Miska

[57] ABSTRACT

A cap (2) is made of sintered hard metal and has on the inside a cylindrical surface (20) and a frusto-conical surface (21) that are true ground. The cap's cylindrical surface (20) is fitted with radial play around an outer cylindrical surface (9) of an underlying middle (1) and the cap's frusto-conical surface (21) has the same inclination as a subjacent frusto-conical surface (14) on the outside of the middle. The cap (2) and the middle (1) are secured to one another by a ring of deformable material sandwiched between their cylindrical surfaces (9, 20). On the outside the cap (2) is formed over its thicker main portion (18) with a trued and polished surface (22) having the same inclination as its inside frusto-conical surface (21) such as to provide the thicker portion (18) with a parallelogrammatic cross-section.

10 Claims, 3 Drawing Sheets

WATCH CASE PROVIDED WITH A CAP OF HARD MATERIAL

BACKGROUND OF THE INVENTION

The present invention relates to watch cases whose apparent parts are made of a hard material so as to avoid the risk of being scratched when worn on a wrist.

A first such watch case has been marketed with constant success since 1959. This first watch case is in particular described in Swiss patent specification No. 517963. The constant success of this kind of watch case is due in part to the particular shape of the cap that is shown in FIGS. 1 to 4 of the above specification and which protects the watch in a particularly effective manner.

However, the manufacture of these caps and the manner in which they are secured to an underlying middle have always ran into technical difficulties and many different constructions have been proposed for overcoming these difficulties.

The cap described in Swiss patent specification No. 517963 has an outer, possibly frusto-conical face and on the inside two stepped annular shoulders between which are cylindrical connecting surfaces. It is force-fitted over a correspondingly shaped portion of an underlying middle and glued.

According to Swiss patent specification No. 508925, filed in 1969, the cap is removably mounted by means of an elastic annulus over an underlying middle. To this end, it is formed with an inner groove.

Japanese utility model No. 1046157, filed in 1969, suggests fixing two separate constituent parts of a case body with a malleable metallic element of annular shape sandwiched between the two parts.

Swiss patent specification No. 568040, filed in 1971, proposes still another arrangement by providing a cap having a planar underside in which are embedded tapped studs. The latter enable the cap to be secured to a shoulder on an underlying middle with screws.

Actually, only the arrangement disclosed in the first of the above-mentioned documents has been in constant use, despite the fact that it has always been difficult to achieve an even manufacturing standard.

Recently, however, applicants have found that by giving such a cap a new shape, its manufacture and assembly on an underlying middle could be simplified to a large extent. Further a substantial reduction in the cap's internal stresses had the effect of reducing the likelihood of cracks occurring both during sintering and while wearing the watch.

SUMMARY OF THE INVENTION

The object of the invention is to improve watch cases having a cover of hard material and more particularly to reduce their cost price while increasing their reliability.

To this end, the watch case according to the invention is provided with the features set forth in claim 1.

SHORT DESCRIPTION OF THE DRAWINGS

An embodiment of the watch case provided by the invention will now be described with reference to the accompanying drawings, in which.

Figure 1:
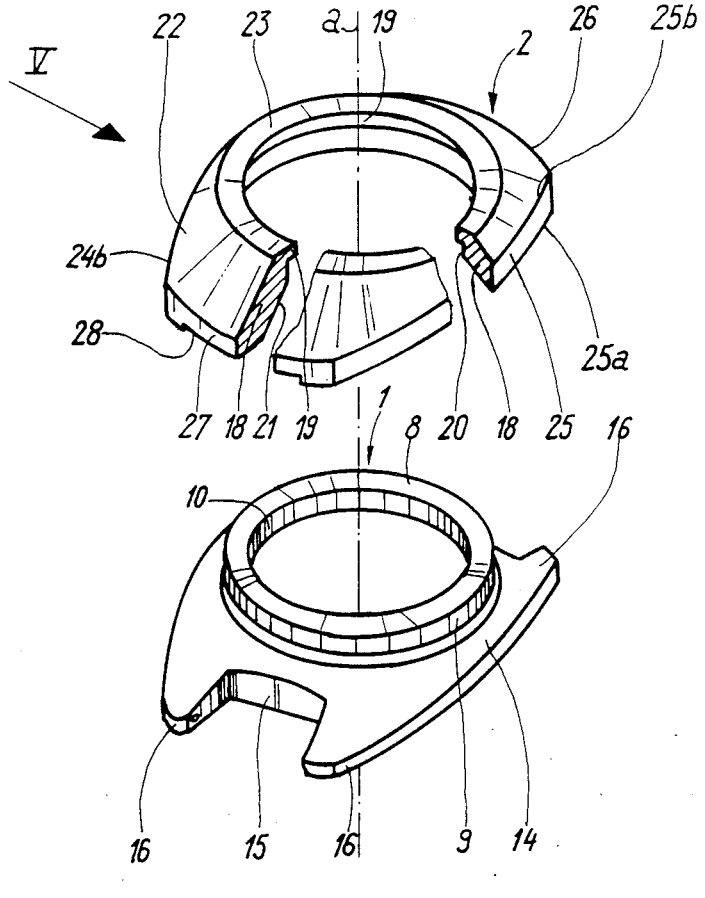
FIG. 1 is an exploded perspective view, and in cross-section, of the main constituent parts of the embodiment.
Figure 2:
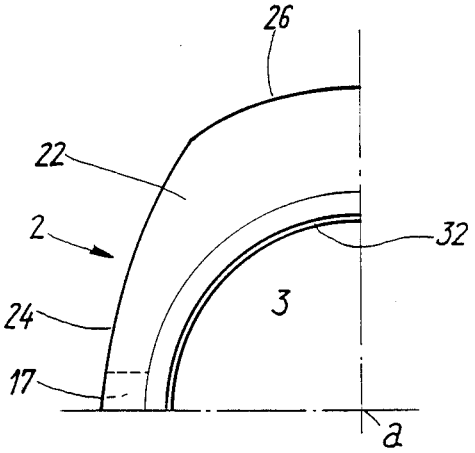
FIG. 2 is a partial view in plan of the embodiment.
Figure 3:
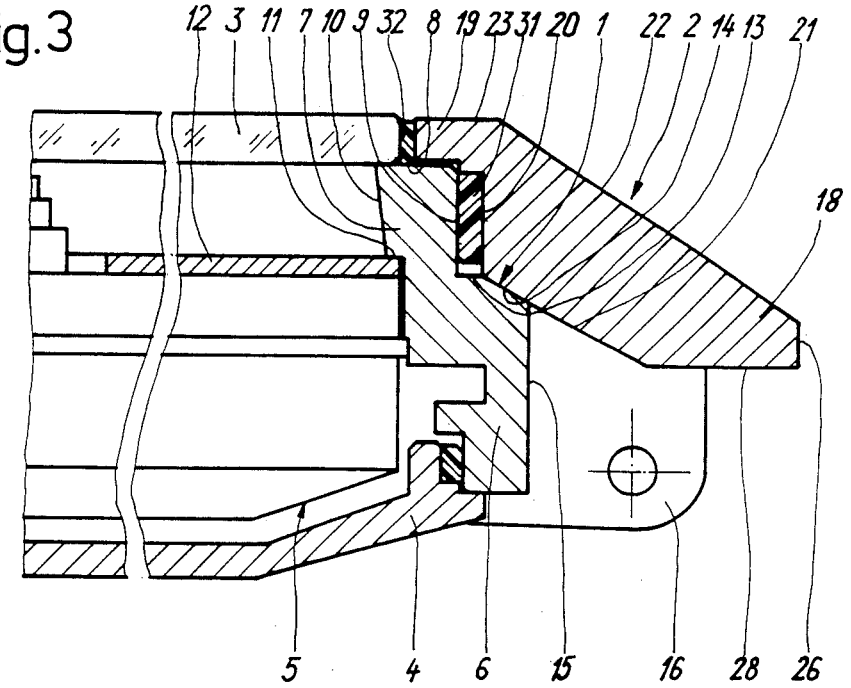
Figure 4:
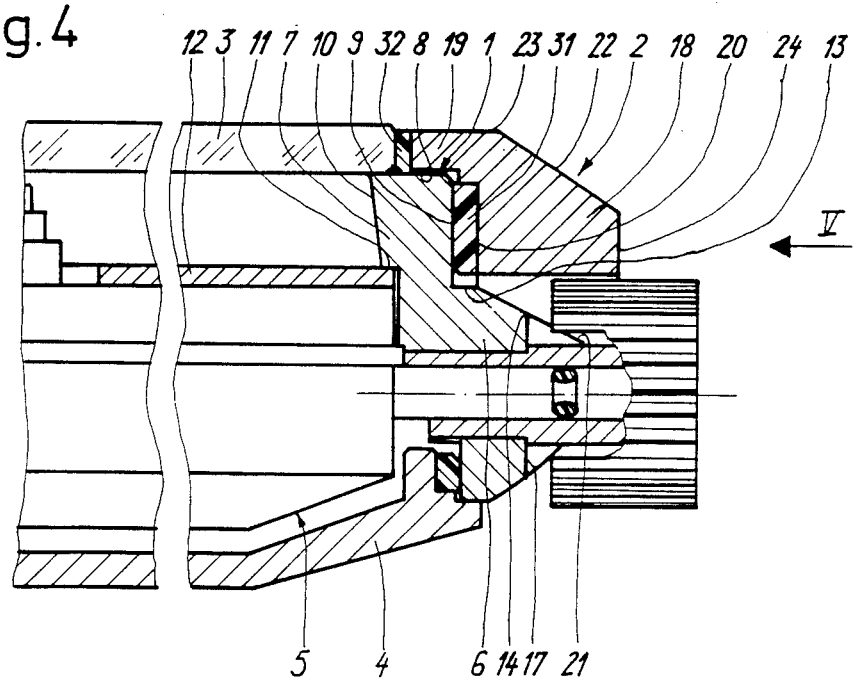
Figure 5:
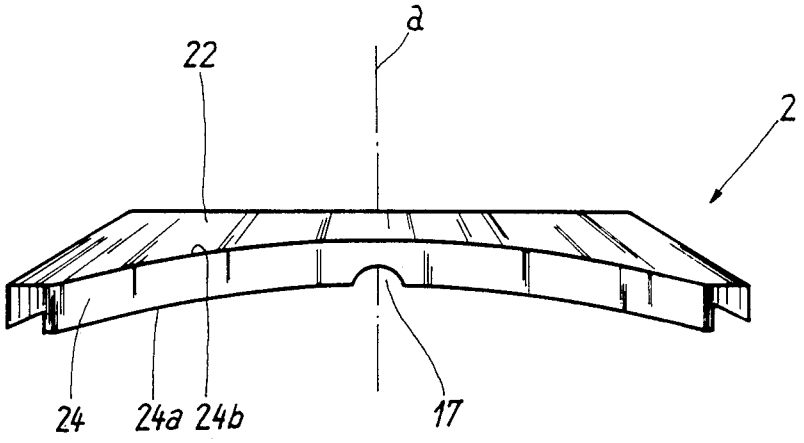

FIGS. 3 and 4 are views, partly in cross-section, along the 6 o'clock–12 o'clock axis and the 3 o'clock axis respectively, of a wrist watch provided with the casing shown in FIGS. 1 and 2; and FIG. 5 is a side view of the cap alone, in the direction of arrow V in FIGS. 1 and 4.

DETAILED DESCRIPTION

The watch case shown in FIG. 3 has four main parts: a middle 1, a cap 2, a glass 3 and a back 4. Glass 3 and back 4 are conventional components whose structure need not be described in detail. Middle 1 and cap 2 have shapes such as to simplify manufacture and facilitate assembly.

Middle 1 is made of an easily machinable metal, e.g. stainless steel. It could also be made of another material, e.g. plastic material. The actual production technique resorted to will be suited to the material being used: profile-turning or stamping and final machining, molding, etc.

Middle 1 is designed to contain a movement 5, preferably of the analog type. Middle 1 has a lower portion 6 and an upper portion 7. Lower portion 6 is solid with back 4; it surrounds and bears movement 5, in a conventional manner which will not therefore be described in greater detail. Upper portion 7 is ring-shaped with a planar top face 8, a cylindrical outer side face 9 and a slightly frusto-conical, inner side spacing face 10. Surface 10 is limited at the bottom by a shoulder 11 intended to maintain the outer edge portion of the dial borne by movement 5. In the adjoining regions of middle portions 6 and 7 and at the foot of surface 9 is provided a planar shoulder 13 whose circular outer edge also forms the top edge of an outer frusto-conical surface 14 forming a bearing surface for cap 2.

The shape of middle 1, in plan, is the same as that of cap 2 and frusto-conical surface 14 extends outwardly to the line that determines the contour of these parts. However, the reentrant spaces 15 between horns 16 and the reentrant space 17 at 3 o'clock for the crown are covered by an edge portion of cap 2.

Cap 2 is a part made of sintered hard metal. It comprises a thicker radially outer portion 18 of annular shape and a thinner radially inner portion 19 that forms an annular flange at the top of portion 18. The latter is limited inwards by a circular cylindrical surface 20, downwards by an inner frusto-conical surface 21 having the same inclination as surface 14 and upwards by a frusto-conical surface 22 that is truncated at the level of the top surface 23 of flange 19.

The cap's side faces include two longitudinal surfaces 24 and 25 whose generatrices are parallel to the common axis a of surfaces 14, 20, 21 and 22 and two circular and coaxial cylindrical surface portions 26 and 27 whose axes coincide with common axis a. Surfaces 24 to 27 thus together define the rim of the watch, which is of rectangular shape with rounded sides, the longer sides of the rectangle being oriented in a direction substantially parallel to the 12 o'clock–6 o'clock axis of the watch. Finally, two planar faces 28, adjacent to spaces 15, define a passage for a wristlet not shown, intended to be secured to horns 16.

As is apparent from FIGS. 3 and 4, the two constituent parts 1 and 2 of the watch case are fixedly fastened to one another by a ring 31 made of deformable material, e.g. an elastomer, engaged in the radial gap provided between coaxial surfaces 20 and 9. Heightwise positioning is achieved, by contact of surfaces 14 and 21. Gasket 31 may be glued.

The cap's manufacture is simplified by the fact that the only surfaces having to be machined to accurate dimensions are surfaces 20 and 21. They can be true ground by automatically operated means suitable for mass production. Surfaces 22 to 27 must be true ground and polished. However, they are planar, frusto-conical or cylindrical surfaces that are located on the outside of the case and whose dimensions are therefore not critical. In fact, even the size of the radial gap between surfaces 9 and 20 will bear substantial machining tolerances, made possible by the deformation of ring 31.

The main advantage of the described construction is its much greater reliability compared to the earlier constructions.

Referring to FIGS. 1, 3 and 4, it will be noted that inner frusto-conical surface 21 and outer frusto-conical surface 22 of the cap's thicker portion 18 have substantially the same inclination so that portion 18 is of substantially constant thickness throughout its length. As a result, because of this inclination and because of the parallel arrangement of inner axial surface 20 and outer axial surfaces 24,25, 26 and 27, the thicker portion 18 of cap 2 has, viewed in longitudinal crosssection (along common axis a), the outline of a parallelogram.

This shape was found to avoid, to an exceptional extent, internal stresses during sintering and as a result the likelihood of cracks occurring.

Glass 3 may be secured in the opening defined by inner flange 19 by means of an intermediate sealing gasket 32 and bears on top face 8.

The above described and illustrated watch case has a pleasing effect conveying an impression of thinness, compared to the watch case disclosed in Swiss patent specification 517963. Referring more particularly to FIG. 5, it will be noted that the bottom edges 24*a* and 25*a* of the longer sides 24 and 25 of cap 2 are curved, i.e. in relation to cap 2 they have a concave shape. These bottom edges 24*a* and 25*a* and the corresponding top edges 24*b* and 25*b* delimit the surfaces of the longer sides 24 and 25 which define bands known as casebands.

Preferably, the two top edges 24*b* and 25*b* are parallel to the corresponding bottom edges 24*a* and 25*a* respectively so that the longitudinally extending, lateral casebands 24 and 25 each have a constant width and a curved appearance opening towards the bottom of the cap, this being the region closest to the wrist.

The shape of these edges and of the casebands is due to the geometric combination between the cap's longer sides which are circular and the frusto-conical shape of the inner and outer surfaces 21 and 22 of the cap's thicker portion 18.

In this connection and as will be observed in FIG. 1, inner frusto-conical surface 21 extends to the sides 24 and 25 of the middle 1 and it opens thereof. Thus, frusto-conical surfaces 21 and circular surfaces 24 and 25 are contiguous and form common edges which are bottom edges 24*a* and 25*a*. Similarly, outer frusto-conical surface 22 is contiguous with side circular surfaces 24 and 25 and defines therewith top edges 24*b* and 25*b*.

Therefore, the curvature of the top edges 24*b* and 25*b* and of the bottom edges 24*a* and 25*a* is defined by the conicity of the surfaces 21 and 22 and by the radius of the longer sides 24 and 25.

Because the conicity of outer surface 22 is substantially the same as that of inner surface 21, top edges 24*b* and 25*b* are substantially parallel to their associated bottom edges 24*a* and 25*a*.

Further, by selecting at least for inner surface 21 an angle at the apex of the cone of about 120° and a radius of curvature for the rounded longer sides 24 and 25 equal to double the distance between these sides and the center of the watch, it is possible to provide the bottom edges 24*a* and 25*a* with a curvature that is akin to that of the wearer's wrist. This curvature, which is particularly noticeable when the middle and the cap have contrasting colors, gives the impression that the watch has a thickness equal to that of the cap alone.

I claim:

1. A watch case comprising a coaxial assembly of two constituent parts, one being a middle made of a machinable material and the other being a cap made of a hard material covering the middle, wherein the middle has an upper portion limited externally by a cylindrical surface, and a lower portion limited externally by a frusto-conical surface, wherein the cap has a thicker portion internally limited by a cylindrical surface having a diameter greater than that of the middle's cylindrical surface, such as to provide a radial gap between said cylindrical surfaces, and downwards by a frusto-conical surface having the same inclination as that of the middle and which is in contact therewith, and wherein an annular fixing element made of deformable material is fitted between said cylindrical surfaces.

2. A watch case according to claim 1, wherein the cap also has an annular, radially inwardly extending flange covering said fixing element.

3. A watch case according to claim 2, wherein a glass is secured to the cap, said glass being fitted within the annular flange through the intermediary of a sealing gasket.

4. A watch case according to claim 3, wherein the middle's upper portion is of tubular shape and defines an inner spacing surface.

5. A watch case according to claim 4, wherein the middle's upper portion extends beneath the peripheral edge portion of the glass and beneath the cap's annular flange.

6. A watch case according to claim 1, wherein the cap's thicker portion is externally limited by an outer frusto-conical surface having substantially the same inclination as the inner frusto-conical surface.

7. A watch case according to claim 1, wherein the cap further has lateral surfaces having generatrices that are parallel to the common axis of said constituent parts, said lateral surfaces defining in plan a rectangular outline having rounded sides.

8. A watch case according to claim 1, wherein said thicker portion, axially of the cap, is of parallelogrammatic cross-section.

9. A watch case according to claim 1, wherein the inner frusto-conical surface opens laterally of the cap, at least along the longitudinal sides thereof that are parallel to the 12 o'clock–6 o'clock axis of the watch case.

10. A watch case according to claim 9, wherein the inner frusto-conical surface and the surfaces of the longitudinal sides have common edges defining for the cap lower edges which are of curved and concave shape, opening towards a wearer's wrist.

* * * * *